US011022262B2

(12) United States Patent
Yao et al.

(10) Patent No.: US 11,022,262 B2
(45) Date of Patent: Jun. 1, 2021

(54) 3D FLAME PROJECTION SYSTEM AND FIREPLACE USING THE SAME

(71) Applicants: Ningbo Singfun Electric Appliance Co., Ltd., Zhejiang (CN); Matthew Alfred Crowe, Zhejiang (CN)

(72) Inventors: Yuchu Yao, Zhejiang (CN); Matthew Alfred Crowe, Zhejiang (CN)

(73) Assignee: Ningbo Singfun Electric Appliance Co., Ltd., Ningbo (CN)

( * ) Notice: Subject to any disclaimer, the term of this patent is extended or adjusted under 35 U.S.C. 154(b) by 0 days.

(21) Appl. No.: 16/439,752

(22) Filed: Jun. 13, 2019

(65) Prior Publication Data

US 2020/0224842 A1 Jul. 16, 2020

(30) Foreign Application Priority Data

Jan. 14, 2019 (CN) ..... 2019100318534

(51) Int. Cl.

| | |
|---|---|
| ***F21S 10/04*** | (2006.01) |
| ***F21V 7/00*** | (2006.01) |
| ***F21V 14/06*** | (2006.01) |
| ***F21V 33/00*** | (2006.01) |
| *F24D 13/00* | (2006.01) |
| *F24C 7/00* | (2006.01) |

(52) U.S. Cl.

CPC ..... *F21S 10/046* (2013.01); *F21V 7/0008* (2013.01); *F21V 14/06* (2013.01); *F21V 33/0092* (2013.01); *F24C 7/004* (2013.01); *F24D 13/00* (2013.01)

(58) Field of Classification Search

CPC ..... F21S 10/04; F21S 10/043; F21S 10/046; F24D 13/00; F24B 1/1808; F24C 7/004; F21V 14/06; F21V 33/0092; F21V 7/0008

See application file for complete search history.

(56) References Cited

U.S. PATENT DOCUMENTS 4,965,707 A * 10/1990 Butterfield ..... F24C 7/004 362/806
6,162,047 A * 12/2000 Hess ..... F24C 7/004 126/512

(Continued)

FOREIGN PATENT DOCUMENTS

CN 101649987 A 2/2010
CN 204084175 U 1/2015

(Continued)

*Primary Examiner* — Cassandra Davis
(74) *Attorney, Agent, or Firm* — Edwin A. Sisson, Attorney at Law, LLC; Jeffrey J. Banyas

(57) ABSTRACT

A 3D flame projection system is provided, comprising a light source and a light-transmittable hood. The light source is disposed inside the light-transmittable hood. The 3D flame projection system further comprises a lens which has different refractive indexes for refracting light generated by the light source and splitting the light into a plurality of light beams at different angles and/or has different light transmittances for allowing light generated by the light source to partially transmit through the lens. The 3D flame projection system has the following advantages: simple structure, low cost, small space occupation, realistic flame dancing effect, and it is advantageous for realization of ultrathin production of fireplaces.

43 Claims, 2 Drawing Sheets

(56) References Cited

U.S. PATENT DOCUMENTS

| | | | | |
|---|---|---|---|---|
| 6,944,982 | B2 * | 9/2005 | Schroeter | F21S 10/04<br>392/348 |
| 9,696,025 | B2 * | 7/2017 | Zhang | F21V 5/008 |
| 2008/0138050 | A1 * | 6/2008 | Moreland | F24C 7/004<br>392/348 |

FOREIGN PATENT DOCUMENTS

| | | | | | |
|---|---|---|---|---|---|
| CN | 206695061 | U | | 12/2017 | |
| CN | 207279510 | U | * | 4/2018 | |
| CN | 208139043 | U | * | 11/2018 | |
| GB | 2438942 | A | * | 12/2007 | F24C 7/004 |

* cited by examiner

3D FLAME PROJECTION SYSTEM AND FIREPLACE USING THE SAME

CROSS REFERENCE TO RELATED APPLICATION

The present application claims the priority of Chinese Patent Application NO.201920055094.0, filed on Jan. 14, 2019, the disclosure of which is incorporated by reference herein in its entirety.

TECHNICAL FIELD

The present application relates to a 3D flame projection system and a fireplace using the same.

BACKGROUND

With the development of economic globalization, electric fireplaces, that are heating installations commonly used in Western countries, have quietly entered people's lives. For electric fireplaces currently available from the market, the flame simulation module generally employs a planar projection principle. For example, Chinese Application No. CN101649987A, entitled FLAME SIMULATION DEVICE, has disclosed a flame simulation device, including an imaging screen, a light source, a light reflecting mechanism and a simulated fuel bed, wherein the imaging screen is opaque; the simulated fuel bend is disposed in front of the imaging screen; the light reflecting mechanism is disposed below the simulated fuel bed; the light source is disposed on a side close to the imaging screen; and, light emitted by the light source irradiates on the light reflecting mechanism and is then reflected by the light reflecting mechanism and projected onto the imaging screen. The technical solution provided by this application has the following disadvantages: directly reflecting and projecting, by the reflecting mechanism, the light emitted by the light source onto the imaging screen, which is a planar projection mode. As a result, the flame looks planar, instead of being three-dimensional, and is thus not realistic enough. Manufacturers have developed flame simulation modules with 3D effects. For example, Chinese Utility model Patent Publication No. CN206695061U, entitled 3D FLAME IMAGING SYSTEM FOR SIMULATING CHARCOAL COMBUSTION, has disclosed a 3D flame imaging system for simulating charcoal combustion, including an imaging light source that irradiates forward, wherein a moving reflective device is disposed in front of the imaging light source; the system further includes a light-transmittable imaging plate; a light transmission space is disposed below the light-transmittable imaging plate; a shading plate is disposed in front of the light-transmittable imaging plate, and a light-transmittable region with a pattern is provided on the shading plate; a reflective imaging plate is disposed in the rear of the light-transmittable plate; modeled light reflected from the imaging light source by the moving reflective device passes through the light-transmittable region on the shading plate, then irradiates on the reflective imaging plate after passing through the light transmission space, and is reflected onto the light-transmittable imaging plate for imaging. The technical solution provided by this utility model has the following disadvantages: complex structure, high cost for the flame imaging solution, large size, and difficulty in the realization of ultrathin production of electric fireplaces. For another example, Chinese Utility Model Patent Publication No. CN204084175U, entitled CEILING LAMP DEVICE FOR ELECTRIC FIREPLACE, has disclosed a ceiling lamp device for an electric fireplace, including: a housing that is disposed outside the ceiling lamp device and used for bearing components inside the ceiling lamp device, and a light source that is disposed inside the housing and used for irradiating a hearth of the electric fireplace, wherein light transmitting holes for allowing light to pass therethrough are formed on a surface of the housing, and the light transmitting holes are used for allowing light emitted by the light source to pass therethrough to irradiate the hearth of the electric furnace. The technical solution provided by this utility model has the following disadvantages: the simulated flame exhibits no flickering and is less realistic.

SUMMARY

To overcome the deficiencies of the prior art, the present application provides a 3D flame projection system with simple structure, low cost, small space occupation and realistic flame dancing effect, and a fireplace using this system in order to realize ultrathin production.

The present application mainly employs the following technical solutions.

A 3D flame projection system is provided, including a light source and a light-transmittable hood, wherein the light source is disposed inside the light-transmittable hood; and the 3D flame projection system further includes a lens which has different refractive indexes for refracting light generated by the light source and splitting the light into a plurality of light beams at different angles and/or has different light transmittances for allowing light generated by the light source to partially transmit through the lens.

The 3D flame projection system further includes a motor, with the lens being connected to a motor shaft of the motor and the rotation of the motor shaft driving the lens to rotate together.

The lens is disposed between the light source and the light-transmittable hood.

A fireplace is provided, which uses the 3D flame projection system described above.

The fireplace includes at least one of fake charcoal, stones, crystal particles and glass particles.

The fireplace includes a tray used for containing at least one of the fake charcoal, the stones, the crystal particles and the glass particles.

At least one of the fake charcoal, stones, crystal particles and glass particles is divided into a front pile and a rear pile, between which a gap is provided.

A reflector used for reflecting light emitted by the 3D flame projection system is provided at the gap.

The fireplace further includes a control system connected to the 3D flame projection system.

The fireplace further includes a heating system, and the heating system includes a heating element and a fan.

The technical solutions provided by the present application have the following beneficial effects: after passing through the lens having different refractive indexes, light is split into a plurality of light beams having different refraction angles, so that a single light ray from the light source is split into refracted light rays having different angles, the dimensionality of the light is increased, and a more realistic 3D flame effect can be produced when the refracted light rays irradiate on the fake charcoal or other positions; and/or, after passing through the lens having different light transmittances, a single light ray from the light source will be scattered to form light beams having different brightness, so that the effect of brightness and darkness of the simulated flame is produced and the 3D flame effect is more realistic. The single light ray from the light source can be formed by a single light source or by a plurality of light sources. Furthermore, in order to make the flame effect more realistic, the lens may be an optical lens with a flame color. The lens rotates along with the motor shaft, so the light is changed in terms of refraction angle and/or brightness, realizing the flickering of the light. Accordingly, the simulated flame exhibits flickering and the effect is more realistic. Since the lens is disposed between the light source and the light-transmittable hood, the lens is closer to the light source, and the use of the small-size lens can easily realize the adjustment of light. Moreover, this structural design realizes a more compact structure of the projection system, reduces the space occupation of the projection system, and is more advantageous for the realization of ultrathin production of fireplaces. The fireplace using this projection system further includes fake charcoal, a tray (an ash collector) and the like, and a reflector is disposed between the fake charcoal and the like, so light irradiating on the reflector can be further reflected onto the fake charcoal, the tray (ash collector), the rear plate or other places. Correspondingly, the simulated flame has a more realistic effect.

BRIEF DESCRIPTION OF THE DRAWINGS

FIG. 4 is a laterally sectional view of a fireplace using the 3D flame projection system according to the present application, in which:

1: light source; 2: light-transmittable hood; 3: lens; 4: motor; 5: fake charcoal; 51: front pile; 52: rear pile; 6: reflector; 7: tray; 8: control system; 9: heating system; 91: heating element; and, 92: fan.

DETAILED DESCRIPTION

The present application will be further described below with reference to the accompanying drawings.

Referring to FIGS. 1-4, a 3D flame projection system is provided, including a light source 1 and a light-transmittable hood 2. The light source 1 is disposed inside the light-transmittable hood 2. The 3D flame projection system further includes a lens 3 which has different refractive indexes for refracting light generated by the light source 1 and splitting the light into a plurality of light beams at different angles and/or has different light transmittances for allowing light generated by the light source 1 to partially transmit through the lens 3. Preferably, the lens 3 has different refractive indexes. More preferably, the lens 3 is designed to have an uneven refraction interface and thus form a plurality of small refraction interfaces. Preferably, to produce a more realistic flame effect, the lens 3 may be an optical lens with a particular color (e.g., the color of the flame). Preferably, the light source 1 and the light-transmittable hood 2 are arranged fixedly. Preferably, the light source 1 is an LED lamp panel. Preferably, hollow holes that are flame-shaped, ripple-shaped or the like are formed on the light-transmittable hood 2; or preferably, the light-transmittable hood 2 is an outer hood with light-transmittable patterns that are flame-shaped, ripple-shaped or the like. More preferably, the light-transmittable hood 2 may be an outer optical transparent hood with a particular color. In this structural design, after passing through the lens having different refractive indexes, light is split into a plurality of light beams having different refraction angles, so that a single light ray from the light source is split into refracted light rays having different angles, the dimensionality of the light is increased, and a more realistic 3D flame effect can be produced when the refracted light rays irradiate on the fake charcoal or other positions; and/or, after passing through the lens having different light transmittances, a single light ray from the light source will be scattered to form light beams having different brightness, so that the effect of brightness and darkness of the simulated flame is produced and the 3D flame effect is more realistic. After the light passes through the light-transmittable hood, a flame shape, a ripple shape or the like is produced. Thus, when the light is projected to the fake charcoal or other places, it is more realistic and vivid.

Figure 1:
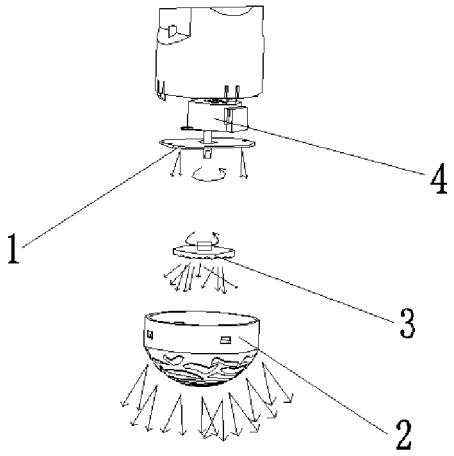
FIG. 1 is an exploded view of a 3D flame projection system according to the present application.
Figure 2:
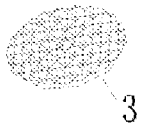
FIG. 2 is a schematic structure diagram of a lens in the 3D flame projection system according to the present application.
Figure 3A:
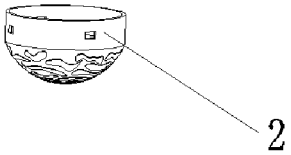
FIG. 3*a* is a schematic diagram of a light-transmittable hood in the 3D flame projection system according to the present application with hollow holes.
Figure 3B:
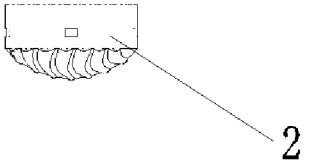
FIG. 3*b* is a schematic diagram of a light-transmittable hood in the 3D flame projection system according to the present application with light-transmittable patterns.
Figure 4:
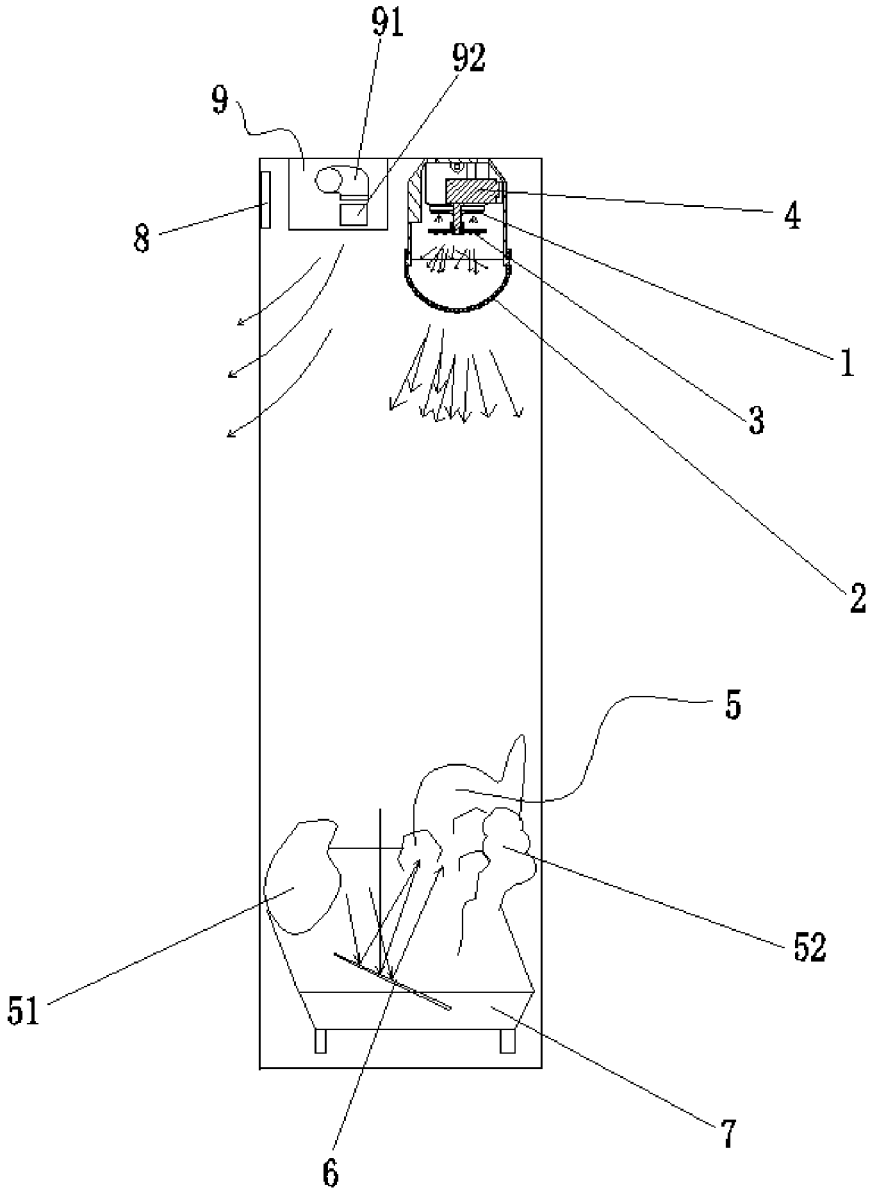

As shown in FIGS. 1 and 4, the 3D flame projection system further includes a motor 4. The lens 3 is connected to a motor shaft of the motor 4, and the rotation of the motor shaft drives the lens 3 to rotate together. Accordingly, when the motor shaft is arranged fixedly, the lens 3 may also be disposed on a main body of the motor 4. In this structural design, the lens rotates along with the motor shaft, so the light is changed in terms of refraction angle and/or brightness, realizing the flickering of the light. Accordingly, the simulated flame exhibits flickering and the effect is more realistic.

As shown in FIGS. 1 and 4, the lens 3 is disposed between the light source 1 and the light-transmittable hood 2. Correspondingly, the lens 3 may also be disposed outside the light-transmittable 2, so the light transmits through the hollow holes or light-transmittable patterns on the light-transmittable hood 2 and then transmits through the lens 3. However, in order to reduce the space occupation of the 3D flame projection system, preferably, the lens 3 is disposed between the light source 1 and the light-transmittable hood 2. In this structural design, the lens is closer to the light source, the use of the small-size lens can easily realize the adjustment of light, and the production cost is reduced. Moreover, this structural design realizes a more compact structure of the projection system, reduces the space occupation of the projection system, and is more advantageous for the realization of ultrathin production of fireplaces.

As shown in FIG. 4, a fireplace is provided, which uses the 3D flame projection system described above. Preferably, the 3D flame projection system is disposed on the top of an inner chamber of a housing of the fireplace. Preferably, the 3D flame projection system may also be disposed on the side face and/or bottom of the inner chamber of the housing of the fireplace. Generally, in order to ensure that the fireplace realizes highly simulated 3D flame, the 3D flame projection system may be disposed on each of the top, side face and bottom of the inner chamber of the housing of the fireplace, and the ON or OFF and intensity of the light source of the 3D flame projection system and the power-on/off and operation speed of the motor are controlled by a control system, so that the brightness of the simulated flame in the fireplace is controlled and the simulation effect is better.

As shown in FIG. 4, the fireplace further includes at least one of fake charcoal 5, stones, crystal particles and glass particles. Preferably, the fireplace includes at least two of fake charcoal 5, stones, crystal particles and glass particles. Preferably, the light emitted by the 3D flame projection system irradiates on the fake charcoal 5 and the rear plate of the inner chamber of the housing of the fireplace, or even irradiates on the reflective material such as crystal particles or glass particles. With the rotation of the lens 3, the flickering of the flame is realized and the realistic 3D flame effect is produced. This is totally different from the effect of the planar projection.

As shown in FIG. 4, the fireplace further includes a tray 7 used for containing at least one of fake charcoal 5, stones, crystal particles and glass particles. After a user purchases a fireplace, at least one of the fake charcoal, stones, crystal particles and glass particles may be provided to the user as a gift. The user may choose to decorate the fireplace with which material according to his/her preference. Thus, the user's fun of DIY is enhanced, and the fireplace is more personalized.

As shown in FIG. 4, at least one of the fake charcoal 5, stones, crystal particles and glass particles is divided into a front pile 51 and a rear pile 51, between which a gap is provided.

As shown in FIG. 4, a reflector 6 used for reflecting light emitted by the 3D flame projection system is provided at the gap. Preferably, the reflector 6 is disposed in the tray 7. Preferably, the reflector 6 is a reflector plate. The reflector plate is arranged at a certain angle so that the light emitted by the 3D flame projection system is reflected onto the front pile 51, the rear pile 52 and/or the rear plate of the inner chamber of the housing of the fireplace. More preferably, the light is reflected onto the rear pile 52 and/or the rear plate of the inner chamber of the housing of the fireplace. Preferably, the reflector 6 may also be a rotating shaft that is driven to rotate by the motor and has reflective sheets provided thereon. More preferably, the reflective sheets are uniformly distributed in a circumferential direction of the rotating shaft. By this structural design, the light irradiating on the reflector can be further reflected onto the fake charcoal, the tray (ash collector), the rear plate of the inner chamber of the housing of the fireplace or other places, and the simulated flame has a more realistic effect.

As shown in FIG. 4, the fireplace further includes a control system 8 connected to the 3D flame projection system. Preferably, the control system 8 receives a user's instruction and controls the ON or OFF and intensity of the light source 1 in the 3D flame projection system, the power-on/off and operation speed of the motor 4 and the like. More preferably, the control system 8 presets a plurality of modes for the brightness of the light source and the operation speed of the motor, and the user may start different modes according to the environmental conditions and personal requirements. The fireplace in such a design can better reflect the personalized requirements of the user.

As shown in FIG. 4, the fireplace further includes a heating system 9. The heating system 9 includes a heating element 91 and a fan 92. Preferably, the heating system 9 is disposed on the top of the inner chamber of the housing of the fireplace. By this hidden structural design, the exposed heating system 9 cannot be seen by the user in appearance. Preferably, the heating system 9 is connected to the control system 8. The control system 8 receives a user's instruction and controls the heating of the heating element 91, and air heated by the heating element 91 is blown out from the fireplace and blown towards the user. More preferably, the control system 8 presets a plurality of modes for the heating strength of the heating element and the operation speed and blowing angle of the fan, and the user may start different modes according to the environmental conditions and personal requirements. Similarly, the fireplace in such a design can better reflect the personalized requirements of the user.

Further, the fireplace further includes a door or curtain used for isolating the user from the inner chamber of the housing of the fireplace. Thus, the fireplace is beautiful in appearance and can better match the style of home decoration. Preferably, the fireplace uses a glass door or a mesh curtain.

Although the specific embodiments of the present application have been described above, a person of ordinary skill in the art may make transformations without departing from the principle or spirit of the present application, and the protection scope of the present application shall be defined by the appended claims and equivalents thereof.

The invention claimed is:

1. A 3D flame projection system comprising a light source, a motor, and a light-transmittable hood, the light source being disposed inside the light-transmittable hood, wherein the 3D flame projection system further comprises a lens which has different refractive indexes for refracting light generated by the light source and splitting the light into a plurality of light beams at different angles and/or has different light transmittances for allowing light generated by the light source to partially transmit through the lens, the lens is designed to have an uneven refraction interface and thus form a plurality of small refraction interfaces, the light-transmittable hood has hollow holes formed on the light-transmittable hood or the light-transmittable hood is an outer hood with light-transmittable patterns, and wherein the lens is connected to a motor shaft of the motor and the rotation of the motor shaft drives the lens to rotate together.

2. The 3D flame projection system according to claim 1, wherein the lens is disposed between the light source and the light-transmittable hood.

3. A fireplace using the 3D flame projection system according to claim 2.

4. The fireplace according to claim 3, comprising at least one of fake charcoal, stones, crystal particles and glass particles.

5. The fireplace according to claim 4, comprising a tray used for containing at least one of the fake charcoal, the stones, the crystal particles and the glass particles.

6. The fireplace according to claim 5, wherein at least one of the fake charcoal, the stones, the crystal particles and the glass particles is divided into a front pile and a rear pile, between which a gap is provided.

7. The fireplace according to claim 6, wherein a reflector used for reflecting light emitted by the 3D flame projection system is provided at the gap.

8. The fireplace according to claim 4, wherein at least one of the fake charcoal, the stones, the crystal particles and the glass particles is divided into a front pile and a rear pile, between which a gap is provided.

9. The fireplace according to claim 8, wherein a reflector used for reflecting light emitted by the 3D flame projection system is provided at the gap.

10. The fireplace according to claim 3, further comprising a control system connected to the 3D flame projection system.

11. The fireplace according to claim 10, further comprising a heating system, the heating system comprising a heating element and a fan.

12. The fireplace according to claim 3, further comprising a heating system, the heating system comprising a heating element and a fan.

13. A fireplace using the 3D flame projection system according to claim 1.

14. The fireplace according to claim 13, comprising at least one of fake charcoal, stones, crystal particles and glass particles.

15. The fireplace according to claim 14, comprising a tray used for containing at least one of the fake charcoal, the stones, the crystal particles and the glass particles.

16. The fireplace according to claim 15, wherein at least one of the fake charcoal, the stones, the crystal particles and the glass particles is divided into a front pile and a rear pile, between which a gap is provided.

17. The fireplace according to claim 16, wherein a reflector used for reflecting light emitted by the 3D flame projection system is provided at the gap.

18. The fireplace according to claim 14, wherein at least one of the fake charcoal, the stones, the crystal particles and the glass particles is divided into a front pile and a rear pile, between which a gap is provided.

19. The fireplace according to claim 18, wherein a reflector used for reflecting light emitted by the 3D flame projection system is provided at the gap.

20. The fireplace according to claim 13, further comprising a control system connected to the 3D flame projection system.

21. The fireplace according to claim 20, further comprising a heating system, the heating system comprising a heating element and a fan.

22. The fireplace according to claim 13, further comprising a heating system, the heating system comprising a heating element and a fan.

23. The 3D flame projection system according to claim 1, wherein the lens is disposed between the light source and the light-transmittable hood.

24. A fireplace using the 3D flame projection system according to claim 23.

25. The fireplace according to claim 24, comprising at least one of fake charcoal, stones, crystal particles and glass particles.

26. The fireplace according to claim 25, comprising a tray used for containing at least one of the fake charcoal, the stones, the crystal particles and the glass particles.

27. The fireplace according to claim 26, wherein at least one of the fake charcoal, the stones, the crystal particles and the glass particles is divided into a front pile and a rear pile, between which a gap is provided.

28. The fireplace according to claim 27, wherein a reflector used for reflecting light emitted by the 3D flame projection system is provided at the gap.

29. The fireplace according to claim 25, wherein at least one of the fake charcoal, the stones, the crystal particles and the glass particles is divided into a front pile and a rear pile, between which a gap is provided.

30. The fireplace according to claim 29, wherein a reflector used for reflecting light emitted by the 3D flame projection system is provided at the gap.

31. The fireplace according to claim 24, further comprising a control system connected to the 3D flame projection system.

32. The fireplace according to claim 31, further comprising a heating system, the heating system comprising a heating element and a fan.

33. The fireplace according to claim 24, further comprising a heating system, the heating system comprising a heating element and a fan.

34. A fireplace using the 3D flame projection system according to claim 1.

35. The fireplace according to claim 34, comprising at least one of fake charcoal, stones, crystal particles and glass particles.

36. The fireplace according to claim 35, comprising a tray used for containing at least one of the fake charcoal, the stones, the crystal particles and the glass particles.

37. The fireplace according to claim 36, wherein at least one of the fake charcoal, the stones, the crystal particles and the glass particles is divided into a front pile and a rear pile, between which a gap is provided.

38. The fireplace according to claim 37, wherein a reflector used for reflecting light emitted by the 3D flame projection system is provided at the gap.

39. The fireplace according to claim 35, wherein at least one of the fake charcoal, the stones, the crystal particles and the glass particles is divided into a front pile and a rear pile, between which a gap is provided.

40. The fireplace according to claim 39, wherein a reflector used for reflecting light emitted by the 3D flame projection system is provided at the gap.

41. The fireplace according to claim 34, further comprising a control system connected to the 3D flame projection system.

42. The fireplace according to claim 41, further comprising a heating system, the heating system comprising a heating element and a fan.

43. The fireplace according to claim 34, further comprising a heating system, the heating system comprising a heating element and a fan.

* * * * *